United States Patent [19]

Prada

[11] Patent Number: 4,462,437

[45] Date of Patent: Jul. 31, 1984

[54] DOOR CONTROL DEVICE WITH CLOSURE REGULATOR

[75] Inventor: Luis E. Prada, Louisville, Ky.

[73] Assignee: General Electric Company, Louisville, Ky.

[21] Appl. No.: 328,978

[22] Filed: Dec. 9, 1981

[51] Int. Cl.[3] ..... B65B 3/04

[52] U.S. Cl. ..... 141/360; 16/72; 188/298; 251/54

[58] Field of Search ..... 141/351–362; 188/266, 298; 16/134, 58, 61, 52, 85, 80, 72; 251/54

[56] References Cited

U.S. PATENT DOCUMENTS

| | | | |
|---|---|---|---|
| 2,460,116 | 1/1949 | Bazley | 267/1 |
| 2,833,347 | 5/1958 | Terry | 161/1 |
| 2,954,966 | 10/1960 | Cushman | 258/1.2 |
| 2,961,233 | 11/1960 | Ullrich, Jr. | 267/1 |
| 2,963,259 | 12/1960 | Heyer et al. | 251/48 |
| 3,078,966 | 2/1963 | Thomas | 188/88 |
| 3,118,167 | 1/1964 | Morris et al. | 16/82 |
| 3,357,040 | 12/1967 | McDonald | 16/51 |
| 3,392,419 | 7/1968 | Stein et al. | 16/49 |
| 4,069,545 | 1/1978 | Holet et al. | 16/49 |

*Primary Examiner*—Houston S. Bell, Jr.

*Attorney, Agent, or Firm*—Frederick P. Weidner; Radford M. Reams

[57] ABSTRACT

Apparatus for controlling opening and closing movement of a door including manual actuation for opening the door and then biasing the door toward its closed position. A device for slowing and impeding movement of the door in the closing direction includes a flexible sealed container with a high viscosity fluid arranged to reciprocate in one direction responsive to opening the door and in the opposite direction to closing the door. A channel has a first section and a second section with the side walls and a sloping bottom wall between the sections providing a roller guide. A roller in contact with the sealed container is freely movable and has rotary and reciprocating motion within the roller guide of the stationary channel upon engagement with the flexible sealed container. Movement of the door to its open position will move the roller into the first channel section and movement of the door to its closed position moves the roller into the second section causing the sealed container to be deformed by the roller and movement of the door to its closed position is slowed and impeded by reason of viscosity of the material in the sealed container.

4 Claims, 8 Drawing Figures

DOOR CONTROL DEVICE WITH CLOSURE REGULATOR

BACKGROUND OF THE INVENTION

The present invention is related to door closure devices and, more particularly, is directed towards a regulator for controlling the opening and closing movement of a duct seal door of an ice dispenser in a household refrigerator and which, even more particularly, slows down the closing movement thereof while allowing relatively unimpeded opening movement.

Unique door closure devices exist for particular door closure requirements. Such requirements dictate the utilization of design criteria that take into account, for example, the speed with which the door must be opened, the speed with which the door must be closed, the spring forces necessary to effectuate or control such speeds, and the like. Other design criteria take into account the environment within which the door control device is to be situated, servicing requirements, ease of installation, manufacturing expense, reliability, and the like.

A specific application of a door control device which is recognized as being one in which the device must provide rather unique operating characteristics is in the control of a duct seal door employed for opening and closing an ice passageway of an automatic ice dispenser mounted within a household refrigerator. As recognized in U.S. Pat. No. 3,548,444 to Jacobus et al, such a door must be openable by the application of a small force, and the control device should close the door to completely seal the ice passageway upon the removal of that force. One major requirement recognized by Jacobus et al is that such a device must be operable in a manner such that the door will not close before the dispensed ice pieces enter the passageway serviced by the door.

The Jacobus et al patent teaches a device which meets the foregoing design requirements by utilizing the principle of inertia. In the Jacobus et al invention, the duct seal door is linked through speed-multiplying gears to an inertia wheel. When a power spring begins to close the door upon removal of the manual force required to keep it open, the inertia wheel, which initially tends to remain at rest, begins to rotate slowly, gradually picking up speed. This motion is transmitted to the door to slow its closure rate. Although the Jacobus et al device is widely utilized and has been found to be reliable, it nevertheless requires the coaction of a large number of mechanical parts which increases costs over a less complex device and is difficult to service easily.

The most pertinent prior art U.S. patents uncovered during the course of a novelty search of the present invention include the following: U.S. Pat. Nos. 2,961,233 and 3,078,966. However, none of the foregoing are believed to teach or suggest the unique structural features of the instant invention as set forth more fully hereinbelow.

It is therefore a primary object of the present invention to provide a door control device for the duct seal door of an automatic ice dispenser installed in a household refrigerator which is much simplified over prior designs, requires fewer moving parts, is more easily serviceable, is less expensive to manufacture, and which provides high reliability in operation.

Another object of the present invention is to provide a door control device which utilizes a closure regulator with which the closure rate of the door may be slowed while unimpairing the opening speed thereof.

An additional object of the present invention is to provide means for controlling the speed of opening and closing the duct seal door of an automatic ice dispenser whose mechanical structure and operation is far simplified over the prior art devices of this nature.

A still further object of the present invention is to provide a time delay device for a duct seal door of an ice dispenser for retarding the closure thereof in order to ensure the delivery of all ice which has entered the ice chute serviced by the door, even if the manual force required to keep open the door is removed rapidly.

SUMMARY OF THE INVENTION

In accordance with one aspect of the present invention, there is provided apparatus for controlling opening and closing movement of a door including means responsive to manual actuation for opening the door and means for biasing the door toward its closed position. There is provided a device for substantially slowing and impeding movement of the door in the closed direction and includes a flexible sealed container arranged to reciprocate over a distance and movable in one direction responsive to opening the door and in the opposite direction responsive to closing the door and has contained therein a high viscosity fluid. The device also includes a roller in contact with the sealed container and there is a stationary channel member open toward the sealed container and located adjacent the reciprocating sealed container and housing the roller. The channel has a first section and a second section with side walls and a sloping bottom wall between the sections with the roller movable between the sections. The first section bottom wall is located from the undeformed sealed container a distance substantially equal to the diameter of the roller and the second section bottom wall is located from the undeformed sealed container a distance less than the diameter of the roller, thus, in this arrangement, movement of the door to its open position will move the sealed container and frictionally engage the roller and move it into the first channel section and compress the biasing means and movement of the door to its closed position by the biasing means moves the roller into the second section causing the sealed container to be deformed by the roller and movement of the door to its closed position is slowed and impeded by reason of the viscosity of the material contained in the flexible sealed container.

BRIEF DESCRIPTION OF THE DRAWINGS

Various objects, features and attendant advantages of the present invention will be more fully appreciated as the same become better understood from the following detailed description of the invention when considered in connection with the accompanying drawings, in which.

DETAILED DESCRIPTION OF THE PREFERRED EMBODIMENT

Figure 1:
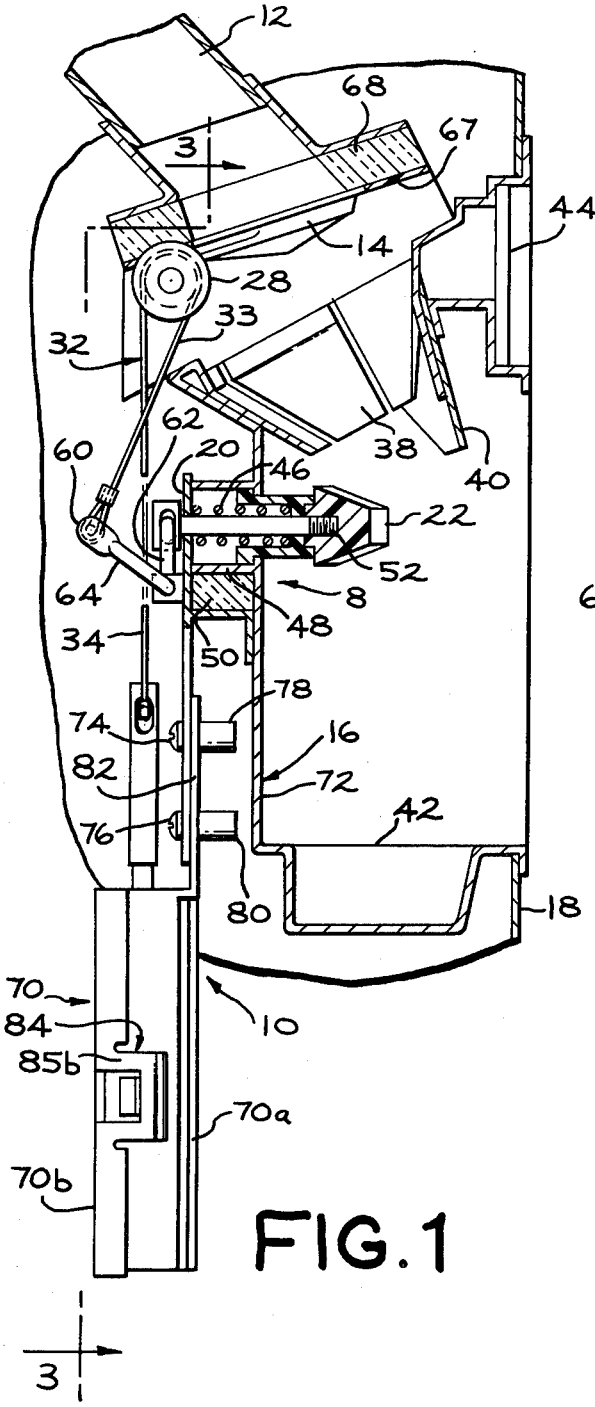
FIG. 1 is a side sectional view of the ice delivery portion of an automatic ice dispensing apparatus including a door control device in accordance with a preferred embodiment of the present invention.
Figure 2:
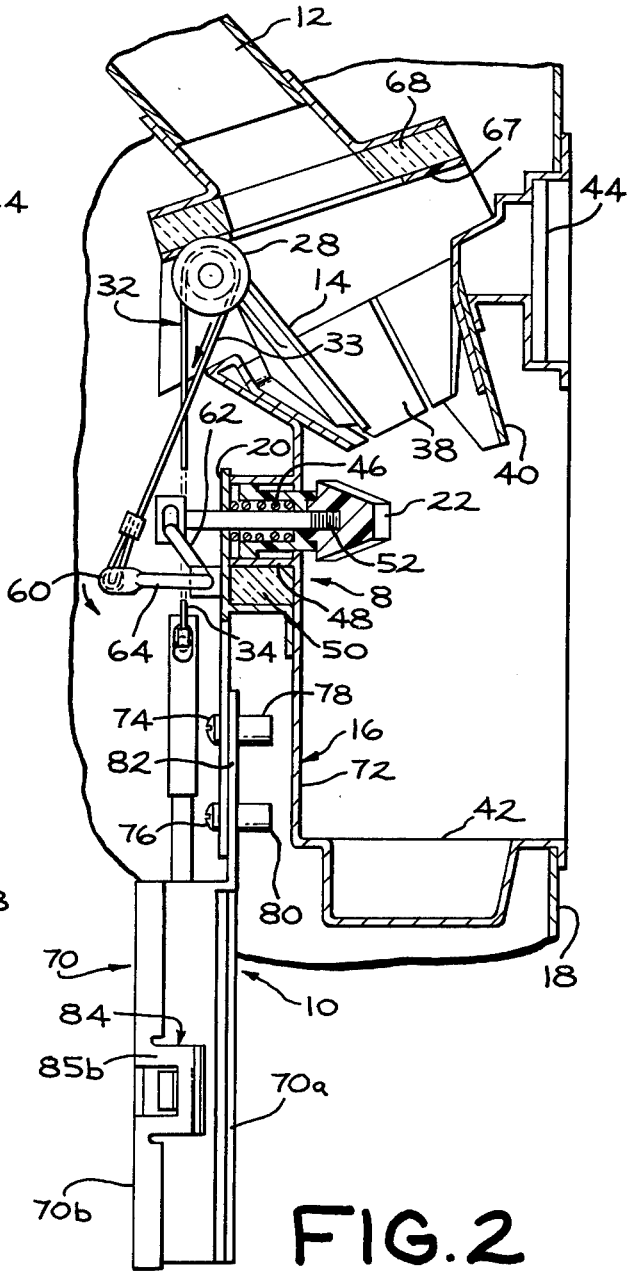
FIG. 2 is the same view of the apparatus illustrated in FIG. 1 but depicts the relative position of the elements thereof with the door in its open position.
Figure 3:
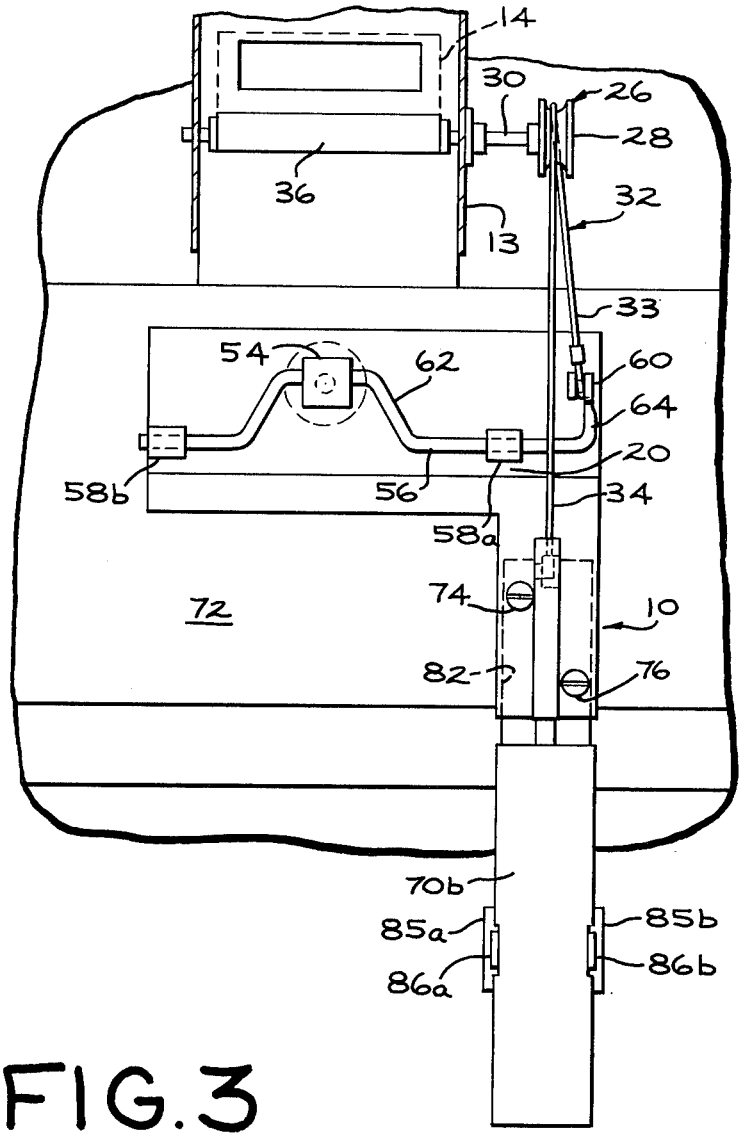
FIG. 3 is another view of the apparatus illustrated in FIG. 1 and taken along line 3—3 thereof.
Figure 4:
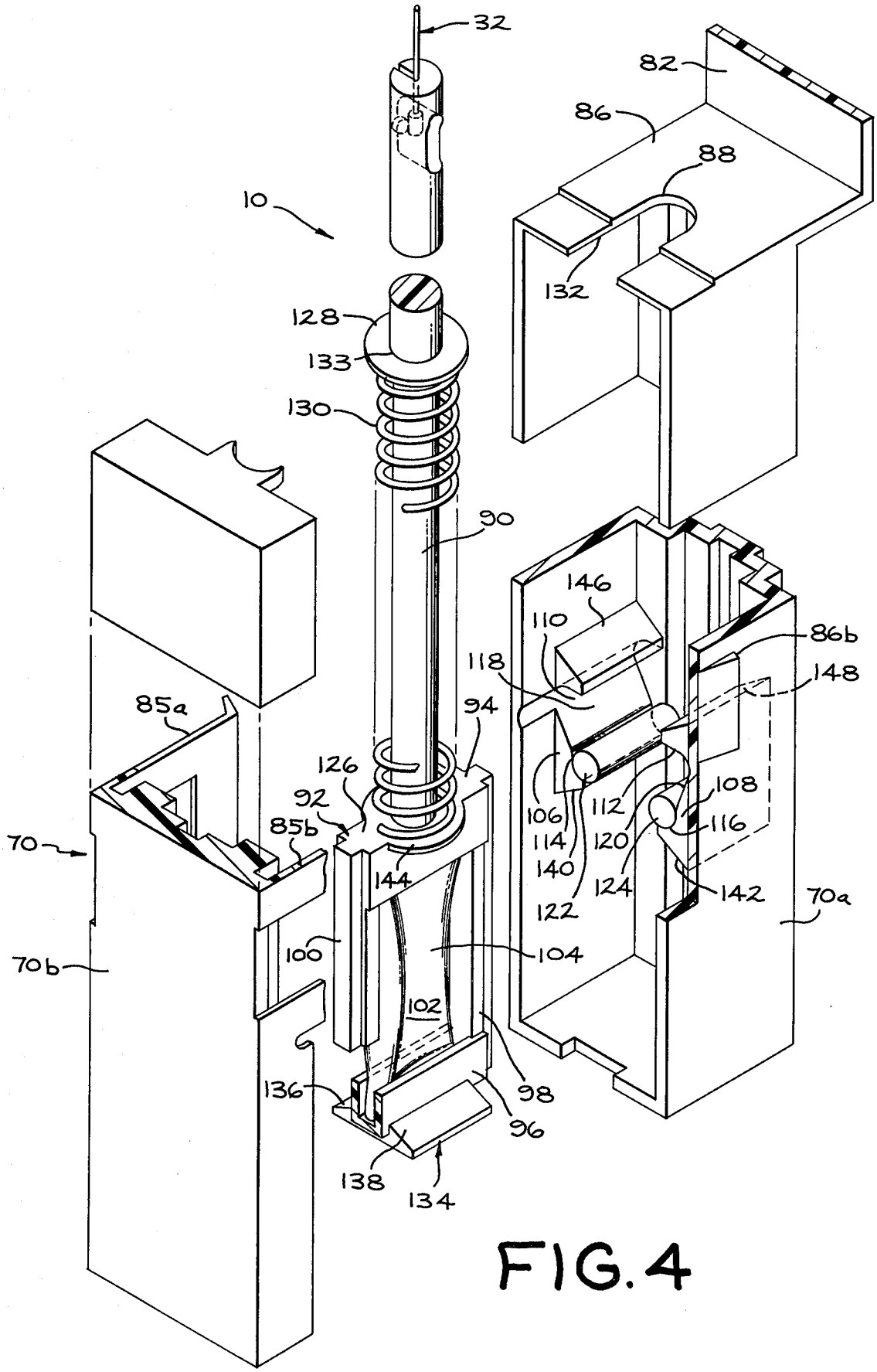
FIG. 4 is an exploded view illustrating the elements which comprise a preferred embodiment of the closure regulator of the door control device of the present invention.

Referring now to the drawings, wherein like reference numerals designate identical or corresponding parts throughout the several views, and more particularly to FIGS. 1 through 3 thereof, a preferred embodiment of the door control device of the present invention is indicated generally by the reference numeral 8 and is illustrated as part of an automatic ice dispenser installed in a household freezer door 18.

Positioned adjacent the outlet of an ice chute 12 is thermal insulation 68 to which is attached a plastic sealing plate 67 which is recessed to receive the duct seal door 14 when closed. Located underneath chute 12 is an ice delivery nozzle 38 which directs ice delivered from chute 12 to the glass or container positioned on a platform 42 of the recessed ice dispenser assembly 16.

Recessed assembly 16 is secured within the outer freezer door 18 of a household refrigerator to provide a convenient dispensation point for the automatic ice dispensing apparatus. Positioned adjacent ice delivery nozzle 38 is a guard lip 40, above which is located a control selector 44 which provides for enabling the user to select either ice cubes or crushed ice to be delivered.

Duct seal door 14 is coupled to a rotatable door actuator assembly indicated generally by the reference numeral 26 in FIG. 3. Door actuator assembly 26 includes a pulley 28 which is coupled to a door shaft 30. Doorshaft 30 is journaled for rotation in the side support walls 13 of ice chute 12. Duct seal door 14 is coupled to shaft 30 via a shaft coupling sleeve 36. Side support walls 13 extend from a rear mounting bracket or support plate 20 which is, in turn, rigidly secured to the recessed ice dispenser assembly 16.

Transversely extending along the mounting bracket 20 is linkage 56 having a pivot end 60. Belt 32 is friction wound about pulley 28 so as to be non-slippingly rotatable therewith. The end 33 of belt 32 is wound about and secured to the pivot end 60 of a connecting arm or linkage 56.

Linkage 56 is rotatably journaled to rear mounting bracket 20 by tubular flanges 58*a* and 58*b* upwardly extending from bracket 20 and surrounding linkage 56. One end of linkage 56 is formed as a belt actuating lever 64 which terminates in the pivot end 60 to which end 33 of belt 32 is connected. The opposite end 34 of belt 32 is connected to a closure regulator 10, the structure and operation of which will become more clear hereinafter.

Disposed intermediate the ends of linkage 56 is a C-shaped actuating link 62 having an actuation point 54 formed at the apex thereof. Actuation point 54 may either be connected to or simply disposed adjacent a pushrod 52 (FIGS. 1 and 2). The distal end of pushrod 52 has mounted thereon a concave glass-receiving pushrod actuator tip 22. Pushrod 52 is disposed within a guide channel 48 extending between the rear wall of recessed assembly 16 and the support plate 20. A return spring 46 is disposed within guide channel 48 for urging pushrod 52 to the right (as viewed in FIGS. 1 and 2). Thermal insulation 50 is preferably disposed about guide channel 48 between bracket 20 and the rear wall of assembly 16.

The operation of the apparatus set forth thus far will now be described with reference to FIGS. 1 through 3. In FIG. 1, the duct seal door 14 is illustrated in its fully closed position in which it substantially covers and seals the opening to ice chute 12. When a consumer places a glass or other container or platform 42 within recessed assembly 16 and manually forces the rear of the container against the concave pushrod actuator 22, pushrod 52 is forced rearwardly (to the left as viewed in FIG. 2) in opposition to the force exerted by return spring 46. The distal end of pushrod 52 moves actuation point 54 of link 62 of linkage 56 to the left (as viewed in FIG. 2) such that linkage 56, as a whole, pivots counterclockwise (FIGS. 1 and 2) about a pivot axis defined by journaling flanges 58*a* and 58*b*.

Disregarding for the moment the action of closure regulator 10, the counterclockwise rotation of linkage 56 also causes belt actuating lever 64 to rotate counterclockwise. Lever 64, in turn, exerts a downward force on end 33 of friction belt 32 which, in turn, causes pulley 28 to rotate clockwise, the action of which is illustrated by the directional arrows in FIG. 2. Rotation of pulley 28 causes, in turn, rotation of door shaft 30, shaft coupling 36, and the resultant movement of duct seal door 14 to its full open position illustrated in FIG. 2.

As long as the sufficient pressure is maintained on actuator 22 of pushrod 52, duct seal door 14 will remain in the position shown in FIG. 2.

Actuation of pushrod 52 also triggers electrical apparatus (not shown) for causing an ice bucket assembly (now shown), disposed just above ice chute 12, to begin dispensing either ice cubes or crushed ice to chute 12. If perchance the operator of the ice dispenser removes his glass or container rapidly from pushrod actuator 22, as is often the case, duct seal door 14 will quickly return, if unrestrained by the closure regulator 10 of the present invention, under the force of biasing means to the position illustrated in FIG. 1 prior to the time necessary for all the ice in ice chute 12 to be dispensed through nozzle 38. It can be appreciated that the provision of a suitable closure regulator in the form of a speed control or time delay to counteract the force of door closure biasing means will result in a set of door closure conditions whereby sufficient time will be provided so that all of the ice disposed within ice chute 12 may be dispensed through nozzle 38, as is necessary to prevent leakage, deterioration of parts, and the like.

Closure regulator 10 time delays the closure of duct seal door 14 by slowing the rotation of the rotatable door actuator assembly 26 from the position illustrated in FIG. 2 in a manner to be described more fully hereinbelow. As will become clear, regulator 10 incorporates, in effect, a retarding action in the application of the closing force, stored in return spring 130, applied to belt 32 to provide the desired retarding or delay function of the closure of duct seal door 14.

Referring now particularly to FIGS. 1–4, a preferred embodiment of the closure regulator 10 of the present invention is illustrated. Regulator 10 comprises a housing 70 having two mating halves 70*a* and 70*b* wherein half 70*a* is the base portion of the housing 70 and is secured to support plate 20 of the ice dispenser assembly 16 as by means of fasteners 74 and 76 through embossments 78 and 80 respectively intregrally formed with a tang 82 forming part of the housing half 70*a*. Housing half 70*b* is a cover that snaps together with housing half 70*a* by means of any suitable latch means 84. In the preferred embodiment, the latch means is simply two resilient legs 85*a* and 85*b* attached to the housing half 70*b* that snap over camming surfaces 86*a* and 86*b* on housing half 70*a* so that the cover 70*b* is retained together with 70*a* as an enclosed housing.

Located inside the housing 70 and extending through the upper end 86 of housing 70 through an apperture 88 is a plunger rod 90 having at its upper end means for attaching belt 32. The opposite end of plunger rod 90 is a framework 92 having a top member 94, a bottom member 96 and side members 98 and 100. Within the framework 92, there is located a flexible sealed container 102 which is gripped and maintained in its proper position by appropriate means formed in the top member 94 and the bottom member 96 of the framework 92. The flexible seal container 102 contains therein in sealed condition a high viscosity fluid 104 such as, for example, a silicone gum.

Within the housing 70 and particularly the base housing half 70*a*, there are opposing stationary channel members 106 and 108 open toward the sealed container 102 and located adjacent the reciprocating sealed container such that the sealed container is between the channel members 106 and 108. Each channel member 106 and 108 has a first section 110 and 112 respectively and a second section 114 and 116 respectively and a sloping bottom wall 118 and 120 between the first and second sections said sections and walls cooperating to provide a roller guide in each channel member with a roller 122 and 124 movable between the first and second sections of each respective stationary channel member. The first section bottom walls 118 and 120 are located from the undeformed flexible seal container 102 a distance substantially equal to the diameter of the respective rollers 122 and 124 and the second sections 114 and 116 of the bottom walls 118 and 120 are located from the undeformed seal container a distance less than the diameter of the rollers 122 and 124. The reason for this arrangement will be explained more fully in connection with the operation of the closure regulator 10.

Captured between the top surface 126 of top member 94 of framework 92 and a remotely located spring retainer member 128 carried by the plunger rod 90 which seats against the interior surface 132 of the upper end 86 of the housing 70 is a compression coil spring 130. With this arrangement, as plunger rod 90 is raised or withdrawn through the apperture 88 in the upper end 86 of the housing 70 and through an opening 133 in the center of the spring member 128 that abuts the interior surface 132 of the upper end 86 of the housing the continued movement of the plunger rod 90 in that direction compresses the coil spring 130 between top surface 126 and the spring retainer surface 128. This action takes place when the duct seal door 14 is being opened by actuation of the door control device 8 as previously described. The coil spring 130 acts as the biasing means to bias the duct seal door 14 toward its closed position. Release of the pushrod actuator tip 22 will allow compression spring 130 to expand and move plunger rod 90 downwardly carrying with it belt 32 attached thereto so that the duct seal door 14 is pulled closed.

The bottom member 96 of the framework 92 has a lower stop member 134 which will stop the movement of plunger rod 90 upwardly by abutting against channels 106 and 108 and for this purpose it will be noticed that the lower stop member 134 has on each side of the bottom member 96 sloped surfaces 136 and 138 respectively and they will abut the lower surfaces 140 and 142 of the channels 106 and 108 respectively. The downward movement of the plunger rod 90 and framework 91 is stopped by means of an upper stop member 144 abutting the upper surfaces 146 and 148 of the channels 106 and 108 respectively. By this arrangement then, the plunger rod 90 is permitted to travel or reciprocate over a defined distance. Accordingly, the flexible seal container 102 carried by the framework 92 attached to the plunger rod 90 will reciprocate over a distance and movable in one direction responsive to opening the duct seal door 14 and in the opposite direction responsive to closing the duct seal door 14.

Figure 5:
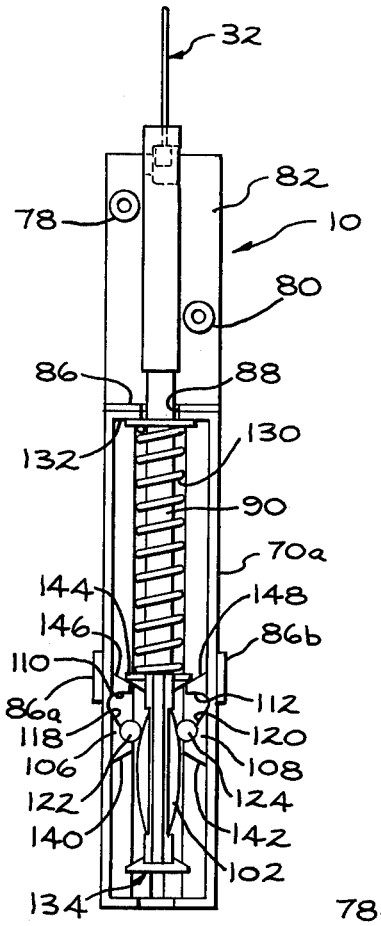
FIG. 5 is a side sectional view illustrating the closure regulator in its normal position when the closure is closed.

With reference particularly to FIGS. 5–8, operation of the closure regulator 10 will now be described. In FIG. 5, the closure regulator 10 is shown in its normal position when the duct seal door 14 is closed and is maintained closed by the biasing spring 130. In this position the plunger rod 90 carrying the framework 92 and in turn the flexible seal container 102 is in its lower or downwardly most position. As such, the rollers 122 and 124 are located and positioned in the second sections 114 and 116 which sections are shaped to cooperate with the cylindrical outer surface of the respective rollers.

Figure 6:
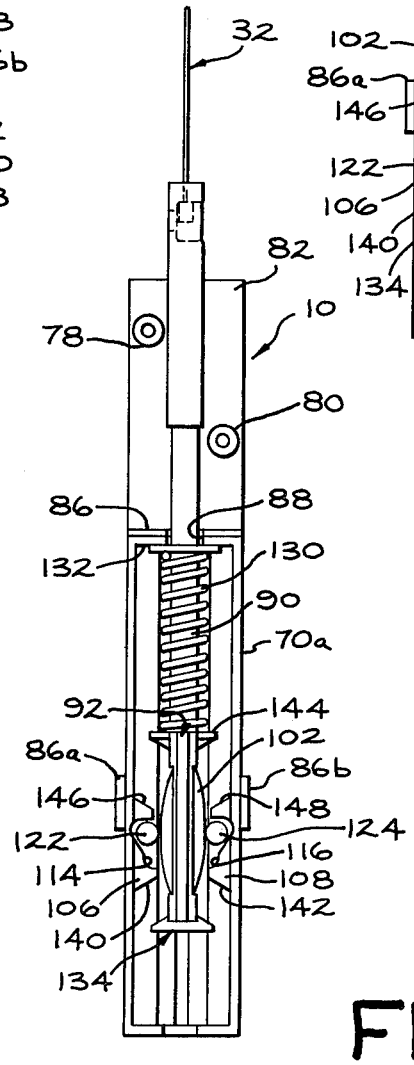
FIG. 6 is a view similar to FIG. 5 showing the closure regulator when the closure is partially opened.

In FIG. 6, the door control device 8 has been actuated at least partially causing the duct seal door 14 to be opened and through the linkage 56 the belt 32 is pulled downwardly and end 34 of the belt 32 fastened to the plunger rod 90 acts to raise the plunger rod 90 upwardly as the belt 32 is wound around pulley 28. During the upward movement of the plunger rod 90, spring 130 is compressed and rollers 122 and 124 are slightly frictionally engaged by the flexible sealed container 102 and caused to rotate upwardly following the sloping bottom walls 118 and 120 until they are located in the first sections 110 and 112 of the channels 106 and 108 respectively.

Figure 7:
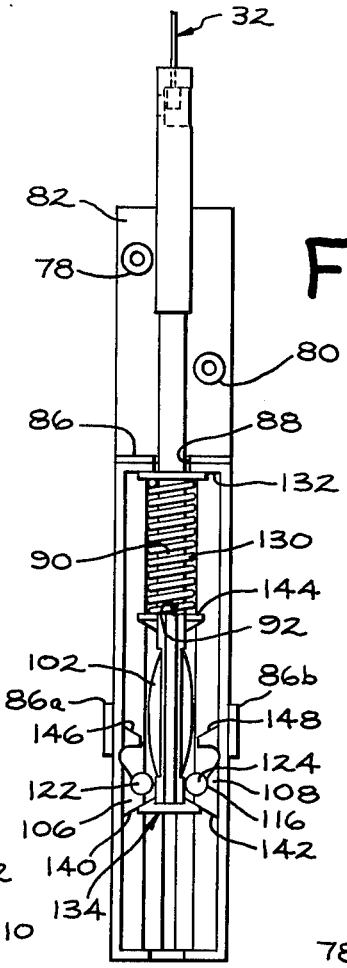
FIG. 7 is a view similar to FIGS. 5 and 6 showing the closure regulator arrangement position when the closure is fully open.

Further upward movement of the plunger rod 90 for achieving complete compression of the spring 130 is continued until lower stop member 134 abuts the lower surfaces 140 and 142 of the channel 106 and 108 and at this time the middle portion of the flexible sealed container 102 has risen above the rollers 122 and 124 which are seated in the first sections 110 and 112 and when no longer frictionally engaged, the rollers by gravity freely descend down the sloping bottom walls 118 and 120 and position themselves in the second sections 114 and 116 as shown in FIG. 7. In this position, the duct seal door 14 is in its fully open position. It will be appreciated that with this arrangement, opening of the duct seal door 14 is accomplished with very little force.

Figure 8:
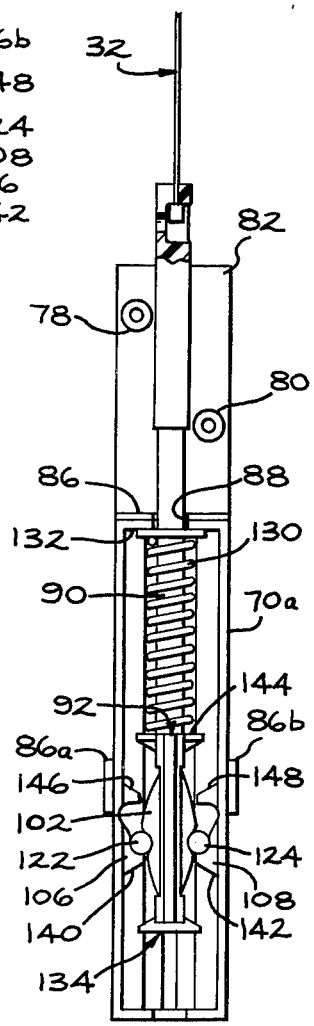
FIG. 8 is a view similar to FIGS. 5–7 showing the closure regulator arrangement during slowed and impeded movement of the closure to its closed position.

With reference to FIG. 8, when the dispensing of ice is completed and the user releases the push rod actuator tip 22, spring 130 expands and moves the plunger rod 90 downwardly carrying with it the framework 92 and the flexible seal container 102. During its downward movement, the flexible seal container, because of the dimensions of the channel sections 114 and 118 comes into contact with the rollers 122 and 124 causing the flexible sealed container 102 to be substantially deformed by the rollers. Continued movement of the door to its closed position by the spring 130 is slowed and impeded by reason of the viscosity of the material in the flexible sealed container 102. The slowed and impeded movement of the door may be adjusted by changing the viscosity of the fluid within the sealed container or by the dimensions of the sealed container and spring bias force. The rate of closing the duct seal door 14 depends upon the design intent.

Obviously, numerous modifications and variations of the present invention are possible in light of the above teachings. It is therefore to be understood that within the scope of the appended claims, the invention may be practiced otherwise than is specifically described herein.

What is claimed is:

1. Apparatus for controlling opening and closing movement of a door, comprising:

means responsive to manual actuation for opening the door;

means for biasing the door toward its closed position;

a device for substantially slowing and impeding movement of the door in the closing direction including;

a flexible sealed container arranged to reciprocate over a distance and movable in one direction responsive to opening the door and in the opposite direction responsive to closing the door and having a high viscosity fluid contained therein, a stationary channel member open toward the sealed container and located adjacent the reciprocating sealed container and housing the roller, said channel having a first section and a second section with side walls and a sloping bottom wall between the sections, said sections and walls cooperating to provide a roller guide in the channel member with the roller movable between the sections, said first section bottom wall located from the undeformed sealed container a distance substantially equal to the diameter of the roller and second section bottom wall located from the undeformed sealed container a distance less than the diameter of the roller, a roller in contact with the sealed container, said roller being freely movable and having rotary and reciprocating motion within the roller guide of the stationary channel member upon engagement with the flexible sealed container, whereby movement of the door to its open position will move the sealed container and frictionally engage the roller and move it into the first channel section and compress the biasing means and movement of the door to its closed position by the biasing means moves the roller into the second section causing the sealed container to be deformed by the roller and movement of the door to its closed position is sloed and impeded by reason of the viscosity of the material therein.

2. The apparatus of claim 1 wherein the device for substantially slowing and impeding movement of the door in the closing direction includes two rollers and two stationary channel members one of each on opposite sides of the flexible sealed container.

3. The apparatus of claim 1 wherein the means for biasing the door towards its closed position is a coil spring and a plunger member carries the flexible sealed container at one end thereof and the coiled spring at the other end and stop means are provided in cooperation with the plunger to limit the flexible sealed container reciprocating distance.

4. The apparatus of claim 3 wherein the means responsive to manual actuation for opening the door is a pulley coupled to the door to rotate the door when the pulley rotates, a belt around the pulley with one end connected to a manually actuatable assembly for pulling on the belt and the other end of the belt connected to the end of the plunger carrying the coiled spring.

* * * * *